US006571573B1

(12) United States Patent
Henry

(10) Patent No.: US 6,571,573 B1
(45) Date of Patent: Jun. 3, 2003

(54) ICE TRANSPORT SYSTEM

(75) Inventor: Paul J. Henry, Andover, MN (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/696,648

(22) Filed: Oct. 25, 2000

Related U.S. Application Data

(60) Provisional application No. 60/161,810, filed on Oct. 27, 1999.

(51) Int. Cl.[7] ..... F25C 1/00

(52) U.S. Cl. ..... 62/344; 62/78; 406/122

(58) Field of Search ..... 406/122, 198; 62/344, 78, 303

(56) References Cited

U.S. PATENT DOCUMENTS

| | | | | |
|---|---|---|---|---|
| 2,975,000 A | | 3/1961 | Davis, Jr. | |
| 3,580,416 A | | 5/1971 | Hoenisch | |
| 3,592,366 A | * | 7/1971 | Markley et al. | 198/523 |
| 3,822,919 A | * | 7/1974 | Strom | 222/195 |
| 3,877,241 A | | 4/1975 | Wade | |
| 3,913,343 A | * | 10/1975 | Rowland et al. | 222/241 |
| 3,930,377 A | | 1/1976 | Utter | |
| 4,104,889 A | | 8/1978 | Hoenisch | |
| 4,177,647 A | * | 12/1979 | Overbye | 62/63 |
| 5,092,526 A | * | 3/1992 | Takata | 239/655 |
| 5,299,427 A | | 4/1994 | Miller et al. | |
| 5,354,152 A | | 10/1994 | Reinhardt et al. | |
| 5,390,501 A | | 2/1995 | Davis et al. | |
| 5,503,198 A | | 4/1996 | Becker | |
| 5,549,421 A | | 8/1996 | Reinhardt et al. | |
| 5,618,136 A | * | 4/1997 | Smoot | 406/93 |
| 5,655,386 A | | 8/1997 | Huang et al. | |
| 5,660,506 A | | 8/1997 | Berge et al. | |

FOREIGN PATENT DOCUMENTS

| | | |
|---|---|---|
| WO | WO 97/27134 | 7/1997 |
| WO | WO 00/08396 | 2/2000 |

* cited by examiner

*Primary Examiner*—William E. Tapolcai
(74) *Attorney, Agent, or Firm*—Sten Erik Hakanson

(57) ABSTRACT

The present invention comprises a pneumatic ice transport system having a primary ice reservoir and a blower connected to a venturi. The ice reservoir includes an ice dispensing mechanism for dispensing of ice there from into an ice flow tube. The venturi suction intake is connected by a tube to the discharge end of the ice chute. The outlet of the venturi is connected to a tube for directing the ice to a remote location. In operation, the blower provides a large volume of relatively low pressure air to the venturi. A heat exchanger can be connected between the outlet of the blower and the air inlet of the venturi. In a preferred embodiment, the heat exchanger uses forced air and melt water from the primary storage bin to cool the air stream produced by the blower. The heat exchanger serves to lower the temperature of that air to at or below ambient. The ice and the associated transport structures of the present invention through which the ice is transported, can also be maintained in a sanitary condition through the use, separately, or in combination, of ozone, chlorine or microbially resistant plastics.

21 Claims, 7 Drawing Sheets

68
69
68a
69

ICE TRANSPORT SYSTEM

This application claims the benefit of provisional application No. 60/161,810, filed Oct. 27, 1999.

FIELD OF THE INVENTION

The present invention relates generally to transport of ice and more particularly to the pneumatic transport of ice from a source thereof to remote ice and/or beverage dispensing locations.

BACKGROUND

Equipment for moving or transporting ice from one location to another is well known in the art. Such equipment has application in the food service industry to move ice from an ice making source thereof to, for example, remote ice/beverage dispensers, thereby negating the need for manual loading of the latter. Manual loading is less sanitary and can lead to accidents from spilled ice on the floor or, for example, as the result of the individual filling the dispenser losing their balance and falling during the filling process. Pneumatic approaches are known where compressed air, in conjunction with a venturi, is used to move ice through tubes to the dispenser. However, dispensers of this type have problems with the noise associated with the use of high pressure air and, the cost of the compressor equipment and the venturi. In addition, compressed air can only be provided for a limited time, given the limited capacity of any reasonably sized compressed air reservoir tank.

Other compressed or forced air approaches are also restricted to sending particularly sized batches of ice one at a time. Thus, further price increasing equipment is required to measure or meter out the correct batch size. This batch approach can also slow down the overall transport process. The prior art transport systems also suffer from the problem of melting a significant portion of the ice prior to and during the transport process. Melting of the ice represents an inefficient loss of energy and can result in the dispensed ice being undesirably "wet". A further concern with ice transport involves the ease and effectiveness with which the system can be cleaned. Disinfectant flushing systems are known, however they suffer from the problems of insuring that such is done regularly, that it is done properly with a sufficiently strong disinfectant mixture and that all of the cleaning solution is completely rinsed and removed.

Accordingly, it would be desirable to have an ice transport system that is low in cost, that is quiet, that can send ice continuously limited only by the available starting volume of ice, that does not require a batch process, that minimizes any loss of ice due to melting during the transport thereof and that can be easily and reliably maintained in a sanitary condition.

SUMMARY OF THE INVENTION

The present invention comprises a pneumatic ice transport system having a primary ice reservoir and a blower connected to a venturi. A heat exchanger is connected between the outlet of the blower and the air inlet of the venturi. In a preferred embodiment, the heat exchanger uses melt water from the primary storage bin to cool the air produced by the blower. The ice reservoir uses an ice dispensing strategy as known and employed in the beverage dispensing industry, to move ice out of a storage bin area to a dispense chute. The venturi ice intake is connected by a tube to the discharge end of the ice chute. In the preferred embodiment, an ice maker is secured to the top of the ice reservoir for providing ice therein. The outlet of the venturi is connected to a tube for directing the ice to a remote location, such as, an ice reservoir bin of an ice/beverage dispenser.

In operation, the blower provides a large volume of relatively low pressure air to the venturi. The heat exchanger serves to lower the temperature of that air to at below ambient thereby reducing melting loss of ice as it is transported. Operation of the dispense mechanism of the primary reservoir causes ice to move into the chute at a preset rate and be sucked into the venturi as a result of the movement of the air there through. The ice is then directed to the remote location. Loss of ice due to melting during transport can also be reduced by supplying cooled air to the intake of the blower.

The ice maker can include a chlorinating device and/or an ozonating device to provide for sanitizing of the water used in the preparation thereof and to keep the ice storage area clean. An ozone system can also be employed to meter predetermined amounts of ozone into the transport tubes for reducing or eliminating microorganisms therein and in the final remote storage locations. In a further embodiment, the transport tube and other plastic components can be infused with various compounds that kill or prevent the growth of microorganisms. Such compounds are mixed in with the plastic material and become and integral component of the formed plastic part. These compounds are then present at the surface of the plastic and provide for the bacteriostatic or bactericidal action thereon.

The present invention was found to operate relatively quietly and can work continuously for as long as ice is available to be transported. The use of a primary reservoir that can actively discharge ice therefrom is a significant improvement over prior art systems that do not have a mechanically accessible storage capacity and can only transport an amount of ice as is harvested from an ice maker after any one cycle thereof. The present invention is also not hampered by any type of batch transport requirement. The heat exchanger serves to reduce ice melting and does so in a cost effective manner by using cold water that was previously unutilized and regarded as waste. A combination of the chlorine, ozone and/or microorganism resistant plastic approaches provide for a transport system that is clean, and reliably so, and that will not degrade or otherwise negatively affect the dispensed ice.

DESCRIPTION OF THE DRAWINGS

A better understanding of the structure, function, operation and advantages of the present invention can be had by referring to the following detailed description which refers to the following drawing figures, wherein.

DETAILED DESCRIPTION OF THE PREFERRED EMBODIMENT

Figure 1:
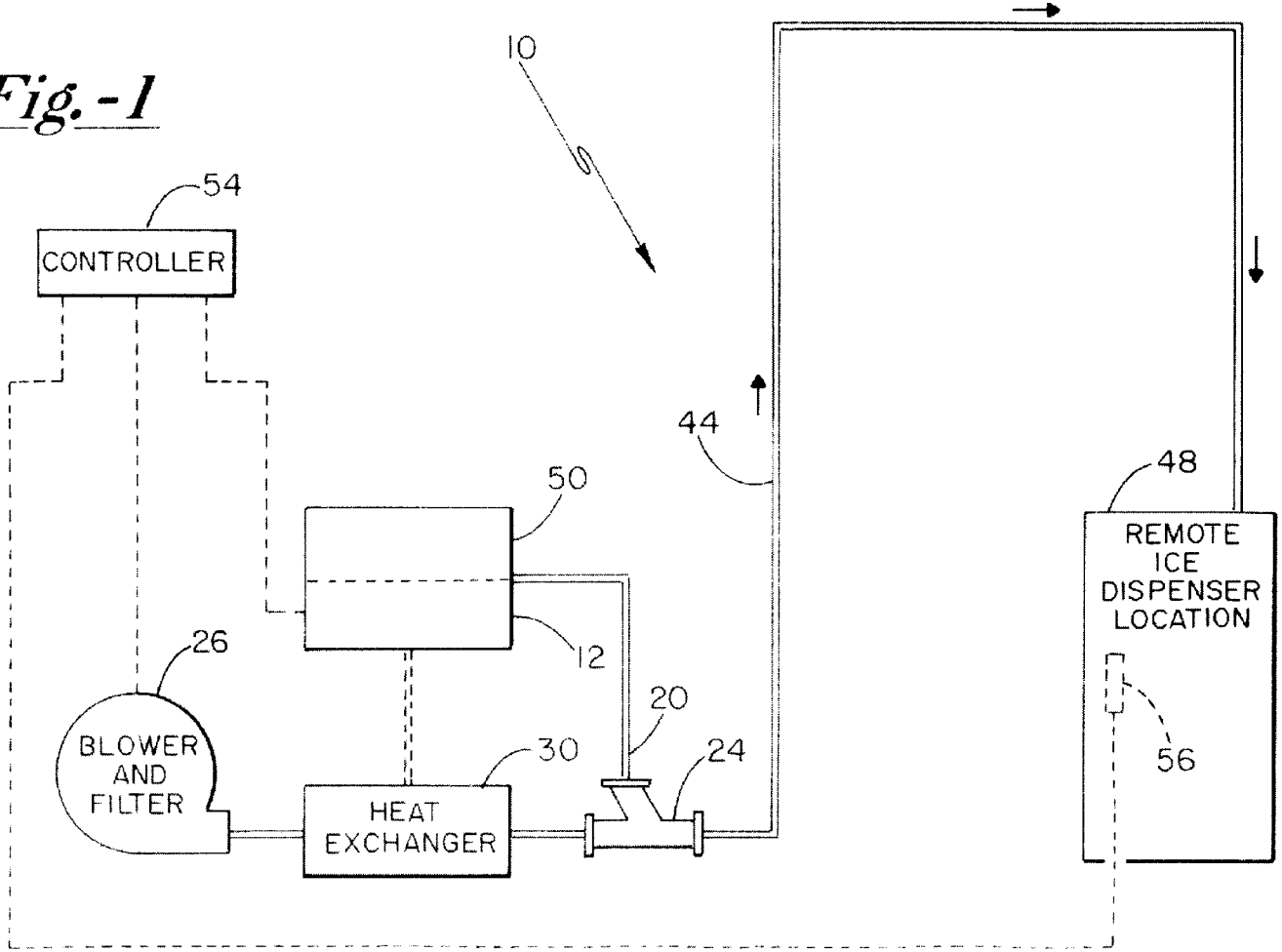
FIG. 1 shows a schematic representation of the ice transport system of the present invention.
Figure 3:
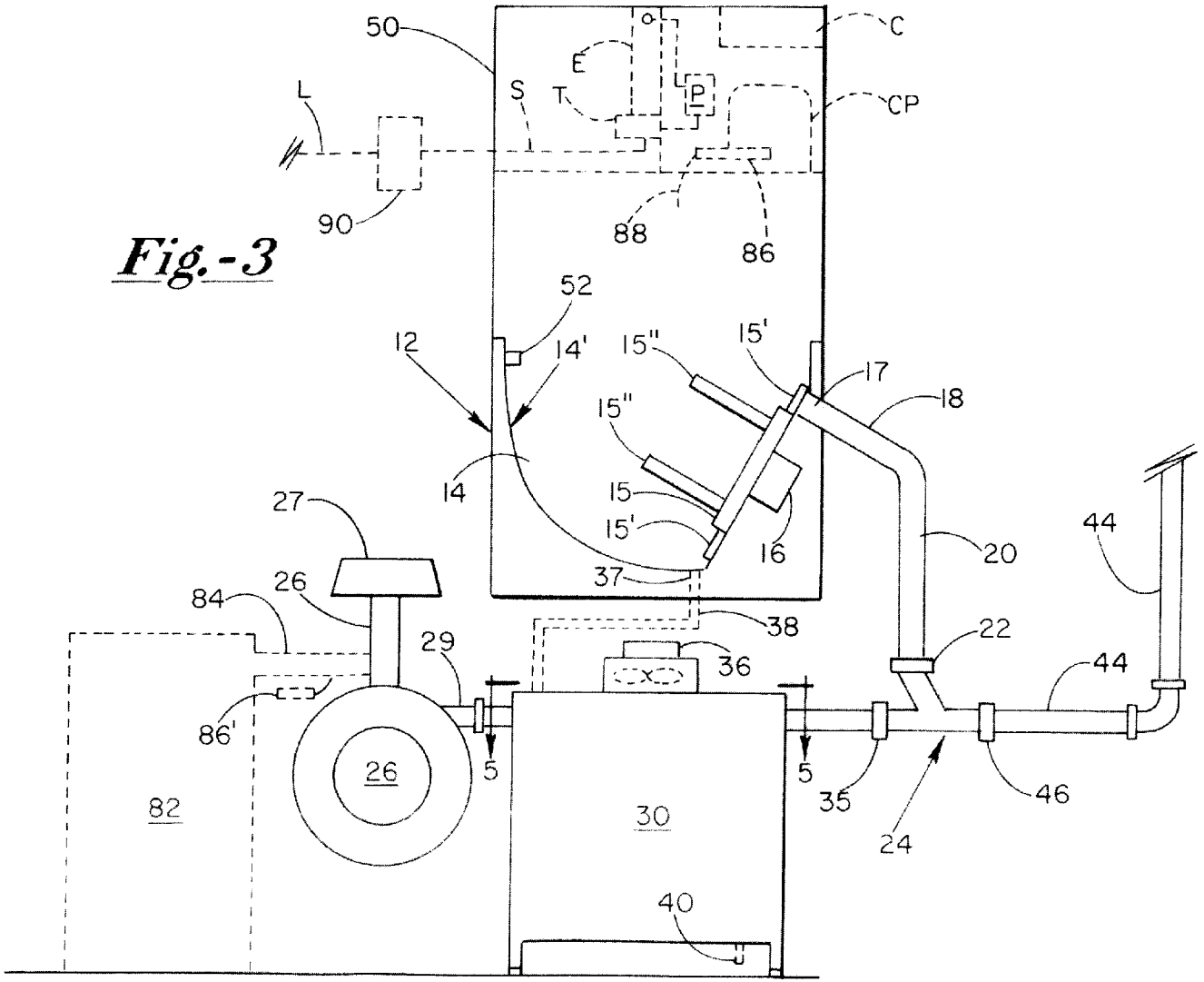
FIG. 3 shows a representational view of the present invention.

The ice transport system of the present invention is seen in FIGS. 1 and 3 and is generally referred to by the numeral 10. Transport system 10 includes an ice dispenser 12 having an ice retaining and dispensing bin 14 as defined by a bin liner 14'. Ice dispenser 12, as will be understood by those of skill, is an adapted combination ice/beverage dispenser of the type well known in the art. Such dispensers typically include a cold plate underlying bin 14 for receiving ice thereon through a hole in liner 14. A portion of the stored ice that falls through such hole cools the cold plate and hence liquid beverage components flowing there through to beverage dispensing valves. Dispenser 12 is different from such ice/beverage dispensers in that it lacks such cold plate and valves, hence a beverage dispensing capacity. However, it does include the insulated ice retaining bin 14 and, as is also well known, a dispensing wheel 15 having ice lifting paddles 15' around the perimeter thereof and ice stirring arms 15". Also, without the need for the valves and a cold plate the ice bin can be designed to provide for increased ice capacity. As is understood, rotation of wheel 15, by a motor 16, lifts ice to chute opening 17 so that the ice then flows down chute 18. Chute 18 is connected to a tube 20 which is, in turn, connected to a suction or ice receiving inlet 22 of a venturi 24. As is known in the art wheel 15 can be turned at different rates by, for example, rheostatic control of motor 16.

Figure 4:
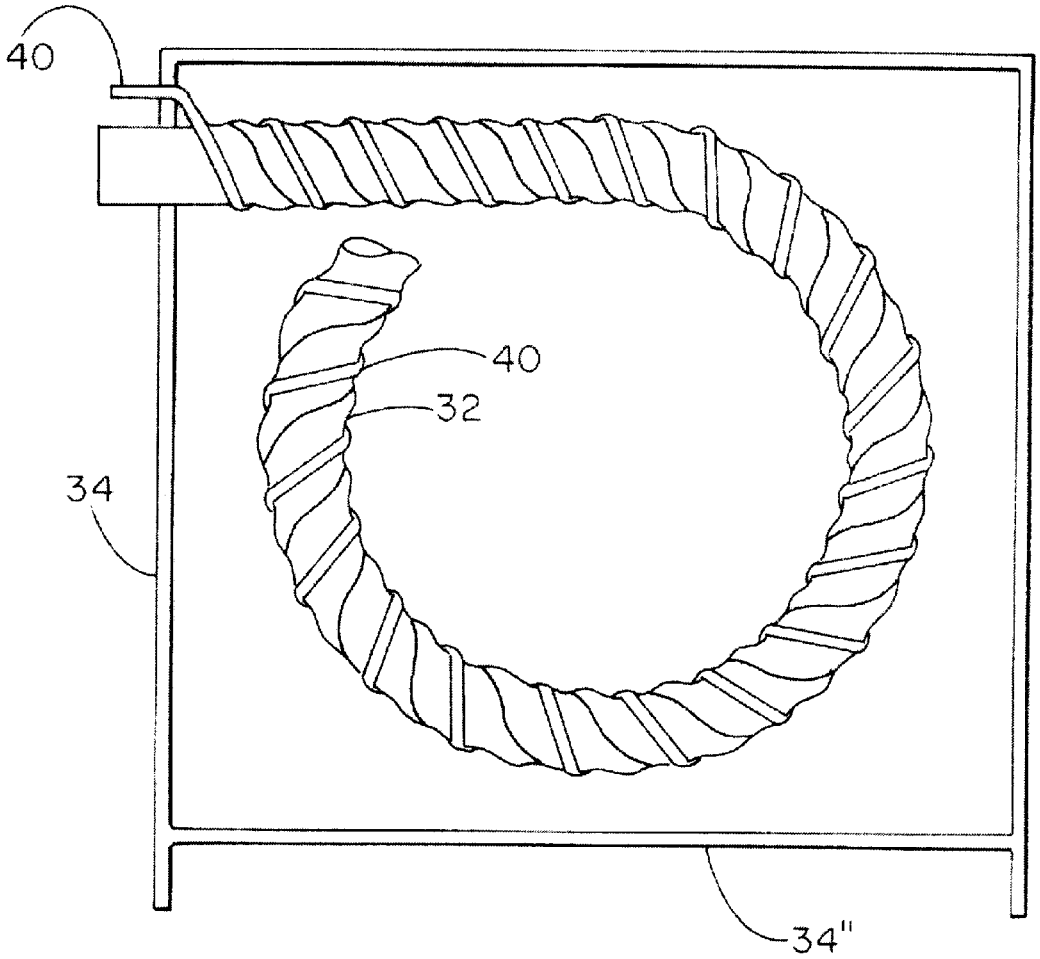
FIG. 4 shows a cross-sectional view of an embodiment of the air to air heat exchanger of the present invention.
Figure 5:
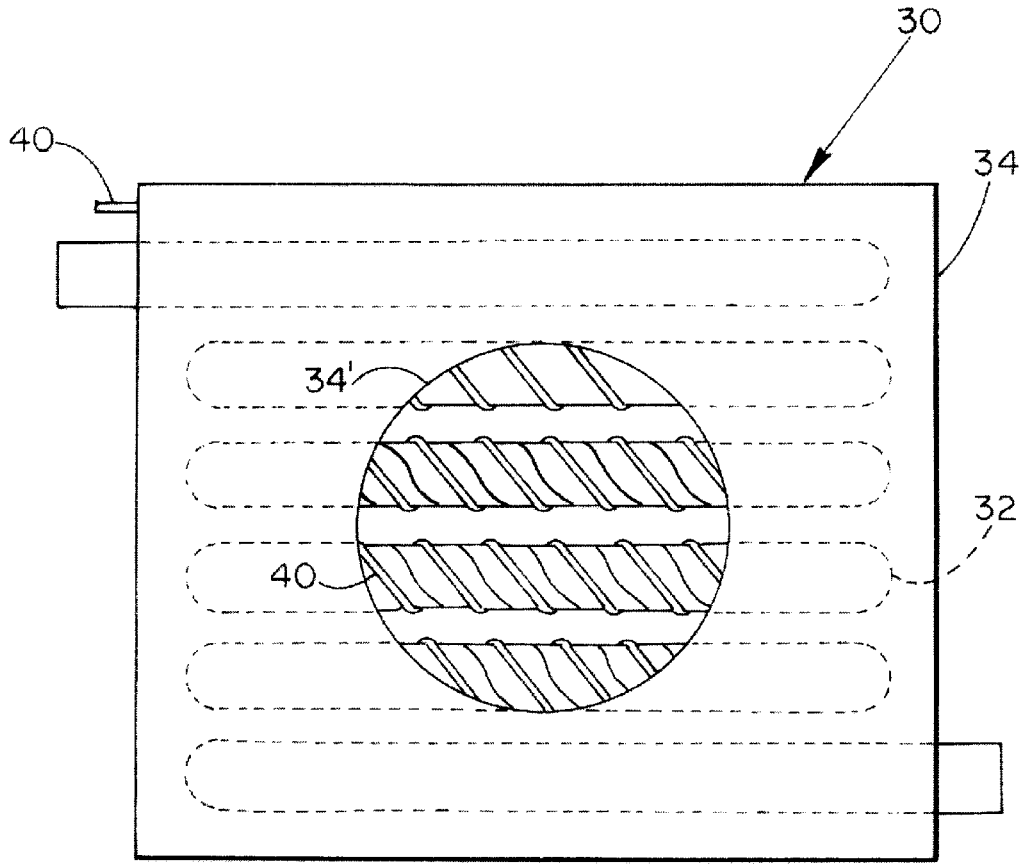
FIG. 5 shows a cross-sectional view along lines 5—5 of FIG. 4.
Figure 6:
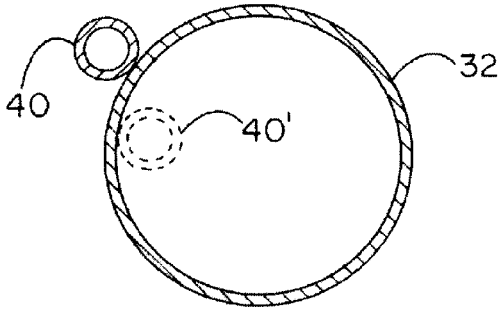
FIG. 6 show a cross-sectional view of the heat exchange tubes of the air to air heat exchanger of the present invention.

A blower 26 includes an air filter 27 on an inlet 28 thereof and an air outlet 29 connected to a water assisted air to air heat exchanger 30. Blower 26 is, for example, of the regenerative type as manufactured by Gast Manufacturing Corporation, Benton Harbor, Mich., denoted a Regenair® model and providing an air flow of 215 cubic feet per minute with a pressure of 95 inches of water. As seen by also referring to FIGS. 4–6, heat exchanger 30 includes a fluted or spiraled coiled tube 32 within an insulated housing 34 thereof. Tube 32 is connected to blower outlet 29 and on its opposite end to air inlet 35 of venturi 24. Tube 32 is made of aluminum and is of the type manufactured, for example, by Delta-T Limited, of Tulsa, Okla. A fan 36 provides for the blowing of air through a housing opening 34' and over tube 32 to exit through a housing air outlet 34". A drain 37 extending from the bottom of bin liner 14 is connected to a tube 38. Tube 38 is connected to a further heat exchange tube 40 that extends around tube 32 in close contact there with and following the spiraled grooves thereof. As seen specifically in FIG. 6, tube 40 can also be placed within tube 32, as indicated by the phantom lined tube marked as 40'. Tube 32 can also be a conventional non spiraled cylindrically surfaced tube, and tubes 40 or 40' can simply extend in a coaxial fashion along the length thereof against the interior or exterior surfaces respectively. In fact, interior tube 40' could extend along a central axis of tube 32 and not in contact with the interior surfaces thereof. Tube 32 extends in a coiled fashion within housing 34 and exits therefrom connecting with an air inlet 42 of venturi 24. An ice transport tube 44 extends from an outlet 46 of venturi 24 to a remote ice storage location 48. Storage location 48 can be for example an ice storage bin, or an ice storage bin as part of an automatic ice dispenser or a combination beverage and ice dispenser.

Figure 7:
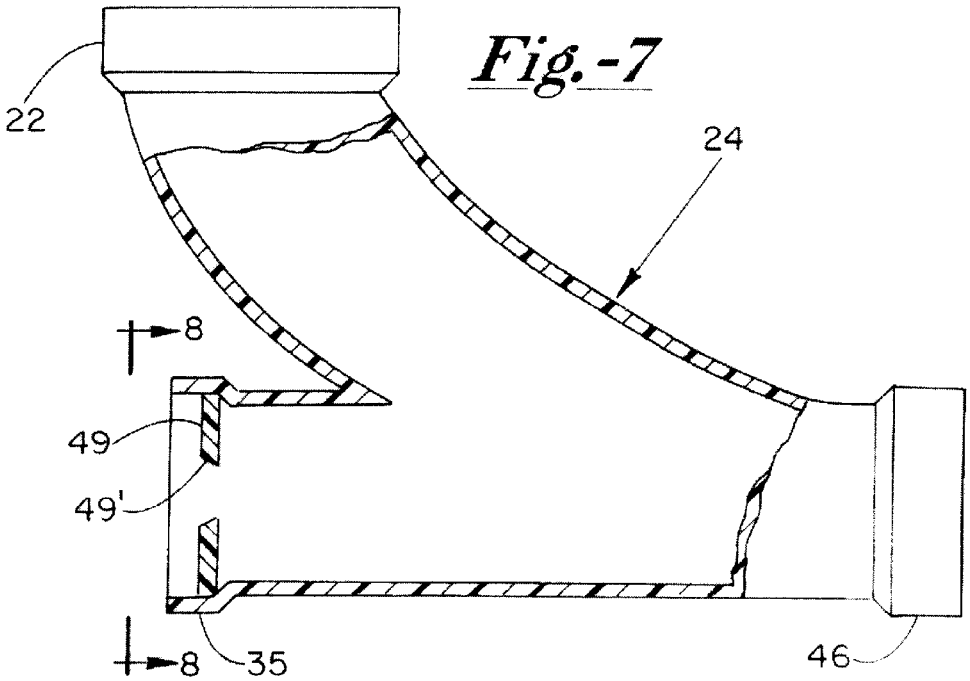
FIG. 7 shows a cross-sectional view of the venturi of the present invention.
Figure 8:
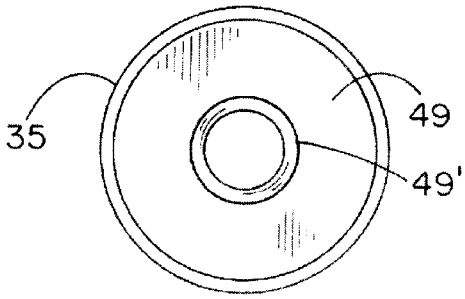
FIG. 8 shows a plan view along lines 8—8 of FIG. 7.

A further detailed view of venturi 24 is seen by referring to FIGS. 7 and 8. As can be understood, venturi 24 consists of a common and inexpensive Y-junction made of polyvinyl chloride (PVC), as is commonly known and used in the plumbing industry.

Such junction is modified herein to include an air flow concentrating disk 49. A disk 49 is received in air inlet end 35 and includes a central conical hole 49' for providing an enhanced venturi effect for providing suction along to tube 20 as is indicated by the air direction flow arrows of FIG. 7.

An ice maker 50 is preferably positioned atop dispenser 12 and provides for making ice to fill bin 14. As is well understood in the art, ice maker 50 includes an ice forming evaporator E, a water pump P fluidly connected to a water reservoir tray T, which tray T is fluidly connected by a fluid level maintaining valve, not shown, to a potable source of water along a line L. A refrigeration system includes a condenser C and a compressor CP. In operation during an ice making mode, water from tray T continually flows over evaporator E by the operation of pump P. At the same time, evaporator E is cooled by the operation the refrigeration system. Ice is therefore built up on evaporator E and harvested when of sufficient thickness. The harvested ice then falls directly into bin 14. An ice bin level sensor 52 is located in bin 14 and connected to a control 54. Control 54 is also operatively connected to the control system of ice maker 50 that regulates the ice making and ice harvesting thereof. A bin level sensor system 56 is located in remote storage location 48 and also connected to control 54. In operation, it will be understood by those of skill that sensor system 56 can actually consist of high and low level sensors. Thus, when the low level sensor indicates low ice, control 54 can operate the transport system 10 of the present invention to deliver ice to location 48 and stop such delivery upon the high level sensor indicating the presence of ice, i.e. that location 48 is full.

With respect to such ice transport, it can be understood that control 54 operates motor 16 resulting in the dispensing of ice from bin 14 down chute 18 into tube 20. At the same time control 54 operates blower 26 and fan 36 to provide for flows of air through and over tube 32 respectively. Ice falling down tube 20 will approach venturi 24 and then be sucked by the action thereof into tube 44 and propelled there along by the air flow produced by blower 26 to be delivered to remote location 48. It will be appreciated by those of skill that a major advantage of the present invention is its ability to continuously transport ice. Thus, ice will be transported to remote location 48 as long as wheel 15 is operated and there is sufficient ice in primary storage bin 14. In that regard, ice bin level sensor 52 and control 54 provide for the operating of ice maker 50 to insure a full reserve of ice in bin 14.

Heat exchanger 30 operates to cool the air produced by blower 26. Those of skill will understand that blower 26 will produce air that is heated typically above that of ambient, particularly where ambient is an air conditioned interior space. Thus, heat exchanger 30, by the operation of fan 34, serves to cool that air before it reaches the ice so as to limit any melting thereof as it is transported. The spiraled tube provides for better heat transfer by presenting greater exterior surface area to the air flow produced by fan 36 and as the air flowing therein has a more turbulent flow, as opposed to a traditional cylindrical tube. Tubes 40 or 40' provide for further cooling of the transport air flow through heat exchange with the cold melt water draining from bin 14 as the ice therein melts. Thus, the present invention provides for use of cooled water that would be otherwise wasted and directly drained away. Those of skill will understand that in certain application where large volumes of ice are not transported and/or transported relatively short distances, such as, less than 20 feet, air exchanger 30 may not be required. In such an installation, blower 26 would simply be directly connected to the inlet 35 of venturi 24. It will also be understood by those skilled in the art that dispenser 12 can include a beverage dispensing capacity where such is desirable at the location thereof. Thus, dispenser 12 can be of the combination ice/beverage type and only slightly modified with respect to connecting the ice chute thereof to venturi 24.

Figure 2:
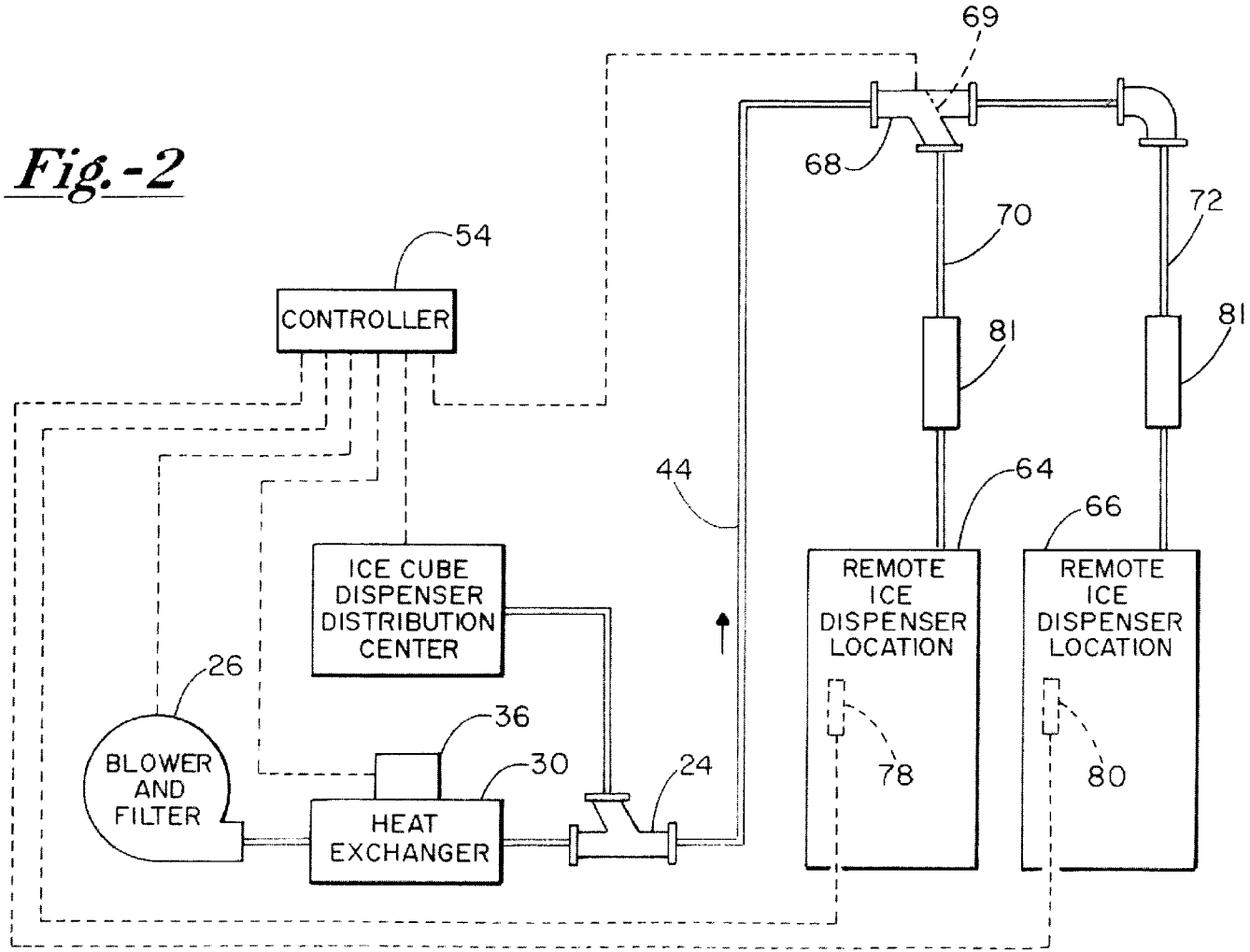
FIG. 2 shows a schematic representation of a further embodiment of the present invention.
Figure 9:
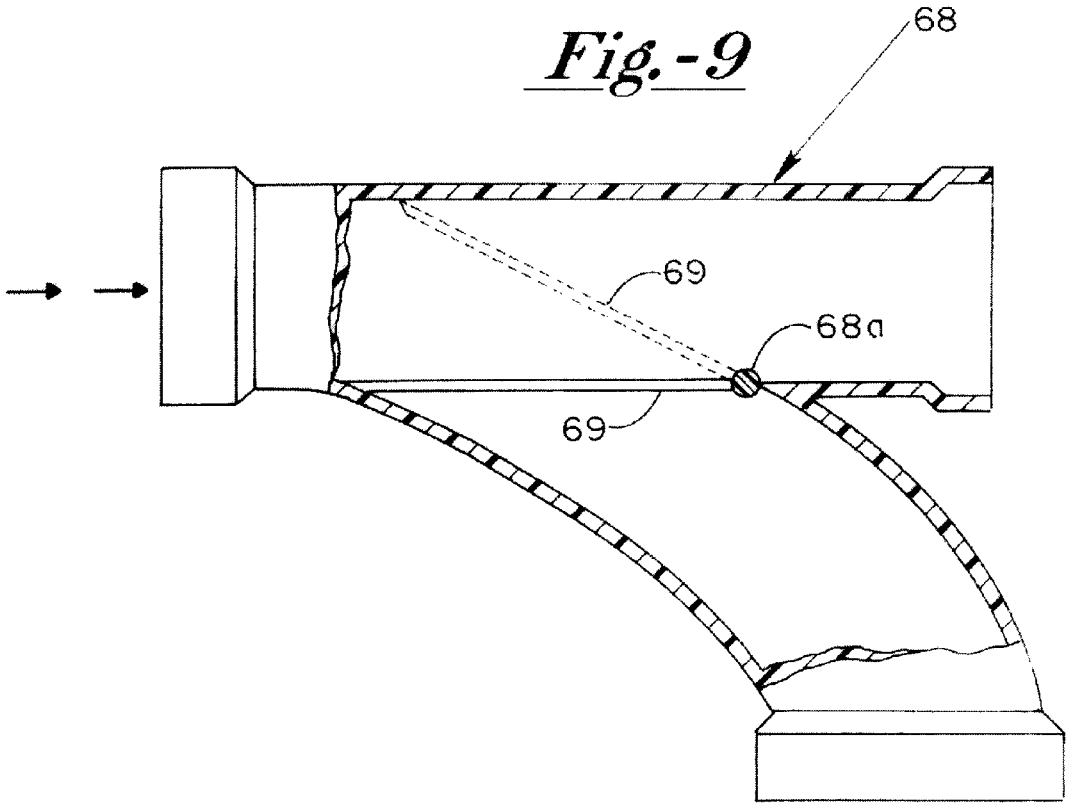
FIG. 9 shows a partial cross-sectional view of the diverter of the present invention.

As seen in the further embodiment depicted in FIG. 2 and generally referred to by the numeral 60, there can be a plurality of remote ice storage/dispensing locations 64 and 66. A diverter provides for directing flow from tube 44 to either one of a plurality of ice transport tubes, such as, tubes 70 and 72 for specific delivery of the ice to remote ice retaining locations 64 and 66, respectively. For example, a diverter 68 is used to direct ice flow selectively thereto. As seen in FIG. 9, diverter 68, as with venturi 24, can be made from a Y-junction as used in venturi 24. A pivoting rod 68*a* extends there through and includes a flapper valve 69 secured thereto. Flapper valve 69 is moveable by a drive means, not shown, such as a solenoid or linear actuator, from a normally closed position, represented by the solid line thereof, to be held in an open position, represented by the dashed line thereof. As can be understood by reference to FIG. 2, when diverter 68 is in the open position ice will be diverted to remote location 64 and will be blocked from entering ice location 66. Conversely, when valve 69 of diverter 68 is in the closed position ice will be delivered exclusively to remote location 66. Those of skill will understand that more than two remote locations could be serviced with the use of additional diverters 68. In such case, only one location would be filled at a time wherein such location would be the only one to have its diverter 68 in the open position, with the remainder in the closed position. Naturally, the "end" location would not require a diverter as ice would be delivered thereto by default wherein all the diverters simply remain in their normally closed position. Control 54 would then be operatively connected to diverter 68 for regulating which tube 70 or 72 ice is directed along as determined by ice level sensing systems 78 and 80 respectively.

Velocity reducers 81 can be used to slow the speed of the individual ice pieces as they flow downward through the tube portions 72 and 74. Reducers 81 consist essentially of an increased diameter tube portion having an exhaust air outlet, not shown. Thus, some of the air pressure moving the ice is reduced as the flow thereof enters the increased diameter section and as that air is permitted to escape there from to ambient. In one embodiment of the present invention wherein a 215 cubic feet m per minute air flow is used, tubes 44, 70 and 72 have an inside diameter of 2 inches and reducers 81 have an inside diameter of 4 inches and a length of 2 feet. Tube portions 70 and 72 will typically have a length of between 4 to 8 feet reaching from the ceiling of the particular installation to the remote storage container. The remote storage containers are typically located between 40 to 90 feet from the primary storage bin 14. Those of skill will appreciate that variation can be made as to tube lengths, diameters thereof, air flow rate and the like to achieve desired results given the demands of a particular installation. Thus, for example, longer or shorter ice transport distances can be provided for and/or the transport of greater amounts of ice per unit time.

The present invention can also be connected to a source of cooled air such as an existing air conditioning system 82. Thus, a duct 84 thereof can be connected to the inlet 27 of blower 26. Also, in this case, outlet 29 of blower 26 could be directly connected to venturi 24 as any heat exchange with the ambient air would be rendered redundant and probably counter productive. In operation, it can be appreciated that cooled air provided by system 82 can significantly and positively reduce the temperature of the ice moving air within the various ice transport tubes. In this manner, any melting of ice as it is transported can be greatly reduced.

As is seen in co-pending application No. 60/124,058, now U.S. Pat. No. 6,324,863 and incorporated herein by reference thereto, ozone can be generated to provide for retarding or reducing the growth of microorganisms in the context of beverage dispensers and ice makers. In the present invention an ozone generator 86 can be similarly connected to ice maker 50, as is disclosed in the above referenced '058 application. Thus ozone can be absorbed directly into the water through a venturi, not shown, connected to a flow of water from pump P. In addition, thereto, or as an alternate method, ozone can simply flow along a tube 88 into bin 14. Additionally, or in the alternative, a further ozone generator 86' can be located adjacent to the air conditioning system 82 and provide for introduction of ozone into duct 84. Use of an ozone generator will provide for increasing the sanitary state of the ice produced by ice maker 50. In addition, that ice will provide some bactericidal and/or bacteriostatic effect with respect to the presence thereof in the various transport tubes as well as in a remote storage location. If ozone is allowed to simply flow by gravitational force down into bin 14, it will likewise have a beneficial sanitizing effect as it settles therein and as a fraction thereof is then sucked into and pushed through the transport tubes to and in the remote ice storage locations. Introduction of ozone into duct 84 can also serve as a strategy for the reduction of the growth of microorganisms in the tube 32 and the associated transports tubes and remote storage locations.

As is seen in co-pending application No. 60/122,935 now U.S. Pat. No. 6,324,863 and incorporated herein by reference thereto, chlorine can also be utilized to provide for a sanitizing effect in the context of beverage and ice equipment. Thus, a chlorine generator 90 can be connected to water supply line L. In this manner, a level of active chlorine can be produced that can reduce or eliminate microorganism growth in the produced ice, and at the same time results in ice that is safe to consume. Use of a chlorine generator 90 separately or in conjunction with ozone generator 86 can likewise provide for beneficial reduction and/or control of the growth of microorganisms in bin 14, as well as the associated transport tubes and remote ice storage locations. Thus, the presence of active chlorine in the ice can provide for a retardation of such growth in those components as it is moved there through, melts and leaves small residues of chlorine therein.

Tubes 20 and 46, or 70, 72 or 74, venturi 24, liner 14', as well as the liners of the remote storage locations 48 or 62, 64 and 66, are comprised of plastic and come into contact with the ice as it is stored and transported. These components can be made of suitable plastic materials that include therein various chemicals that are known to kill or stop the growth of a variety of microorganisms on the surfaces thereof. Examples thereof are seen generally in U.S. Pat. Nos. 5,906,825; 4,401,702. A particular such compound is a wide spectrum antibiotic known as Triclosan, specifically, 2,2,4'trichloro 2'-hydroxy-diphenyl-ether. Expertise in the application of Triclosan in a variety of plastics is provided, for example, by Microban Products Company, Huntersville, N.C. Use of Triclosan or other such anti-microbial in the various plastic ice contact components of the present invention can serve as an additional way to reduce any growth of microorganisms thereon. Such use can be exclusive of, or complementary with, the use of ozone and/or chlorine as described above.

What is claimed is:

1. An ice transport system, comprising:

a primary insulated ice storage bin having an ice dispensing mechanism therein for dispensing ice there from into an ice dispensing chute, a venturi positioned below the ice dispensing chute having an ice receiving inlet connected thereto for receiving ice from the primary ice storage bin when dispensed there from by the ice dispensing mechanism, and the venturi having an air inlet and an air outlet for permitting a flow of air there through in a direction transverse to the ice receiving inlet thereof, a blower having an air inlet and an air outlet, the blower for providing a flow of air to the air inlet of the venturi, an ice transport tube connected on a first end thereof to the air outlet of the venturi and a second end of the transport tube connected to a remote ice storage bin, and sanitizing means for impairing growth of microorganisms within the ice transport system.

2. The ice transport system as defined in claim 1, and further including a heat exchanger fluidly connected between the blower and the venturi air inlet for cooling of the flow of air produced by the blower prior to delivery thereof to the venturi.

3. The ice transport system as defined in claim 1, and the ice dispensing mechanism comprising a dispensing wheel rotatively mounted within the ice storage bin and having one or more ice lifting paddles around the perimeter thereof so that rotation of the dispensing wheel serves to lift ice to the ice dispensing chute.

4. The ice transport system as defined in claim 1, and including an ice maker secured to a top end of the ice storage bin for producing ice to directly fall within the ice storage bin.

5. The ice transport system as defined in claim 1, and the sanitizing means comprising an ozone generator for introducing ozone within the primary ice storage bin.

6. The ice transport system as defined in claim 1, and the sanitizing means comprising an ozone generator for introducing ozone into the air inlet of the blower.

7. The ice transport system as defined in claim 1, and the sanitizing means comprising an ozone generator for introducing ozone into the remote ice storage bin.

8. The ice transport system as defined in claim 1, and the sanitizing means comprising an anti-microbial chemical retained within plastic ice contacting surfaces of the ice transport system for inhibiting microbial growth thereon.

9. The ice transport system as defined in claim 1, and the sanitizing means comprising an anti-microbial chemical retained within various plastic ice contacting surfaces of the ice transport system including an ice bin liner of the primary ice storage bin, the ice dispensing mechanism, the ice dispensing chute, the venturi, the ice transport tube and an ice bin liner of the remote storage ice retaining bin.

10. The ice transport system as defined in claim 1, and the air inlet of the blower connected to a source of cooled air.

11. The ice transport system as defined in claim 4, and the sanitizing means comprising an ozone generator for introducing ozone into water used by the ice maker to make ice.

12. An ice transport system, comprising:

a primary insulated ice storage bin having an ice dispensing mechanism therein for dispensing ice there from into an ice dispensing chute, a venturi positioned below the ice dispensing chute having an ice receiving inlet connected thereto for receiving ice from the primary ice storage bin when dispensed there from by the ice dispensing mechanism, and the venturi having an air inlet and an air outlet for permitting a flow of air there through in a direction transverse to the ice receiving inlet thereof, a blower having an air inlet and an air outlet, the blower for providing a flow of air to the air inlet of the venturi, an ice transport tube connected on a first end thereof to the air outlet of the venturi and a second end of the transport tube connected to a remote ice storage bin, and a heat exchanger fluidly connected between the blower and the venturi air inlet for cooling of the flow of air produced by the blower prior to delivery thereof to the venturi, and the heat exchanger having a heat exchange tube through which air flows from the blower to the venturi, and the heat exchange tube cooled by heat exchange with ice melt water resulting from melting of ice retained in the primary ice storage bin.

13. The ice transport system as defined in claim 12, and further including sanitizing means for inhibiting or reducing any growth of microorganisms within the ice transport system.

14. The ice transport system as defined in claim 13, and the sanitizing means comprising an ozone generator for introducing ozone within the primary ice storage bin.

15. The ice transport system as defined in claim 13, and the sanitizing means comprising an ozone generator for introducing ozone into the air inlet of the blower.

16. The ice transport system as defined in claim 13, and the sanitizing means comprising an ozone generator for introducing ozone into the remote ice storage bin.

17. The ice transport system as defined in claim 13, and the sanitizing means comprising an anti-microbial chemical retained within plastic ice contacting surfaces of the ice transport system for inhibiting microbial growth thereon.

18. The ice transport system as defined in claim 13, and the sanitizing means comprising an anti-microbial chemical retained within various plastic ice contacting surfaces of the ice transport system including an ice bin liner of the primary ice storage bin, the ice dispensing mechanism, the ice dispensing chute, the venturi, the ice transport tube and an ice bin liner of the remote storage ice retaining bin.

19. The ice transport system as defined in claim 12, and the air inlet of the blower connected to a source of cooled air.

20. The ice transport system as defined in claim 12, and including an ice maker secured to a top end of the primary ice storage bin for producing ice to directly fall within the ice storage bin thereof.

21. The ice transport system as defined in claim 20, and the sanitizing means comprising an ozone generator for introducing ozone into water used by the ice maker to make ice.

* * * * *